US012404653B2

(12) United States Patent
Miyazaki et al.

(10) Patent No.: US 12,404,653 B2
(45) Date of Patent: Sep. 2, 2025

(54) TARGET PATH GENERATION SYSTEM

(71) Applicant: KOBELCO CONSTRUCTION MACHINERY CO., LTD., Hiroshima (JP)

(72) Inventors: Ryunosuke Miyazaki, Hiroshima (JP); Masaki Akiyama, Hiroshima (JP); Sho Fujiwara, Hiroshima (JP); Takayuki Doi, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 182 days.

(21) Appl. No.: 18/554,652

(22) PCT Filed: Mar. 8, 2022

(86) PCT No.: PCT/JP2022/009859
§ 371 (c)(1),
(2) Date: Oct. 10, 2023

(87) PCT Pub. No.: WO2022/230368
PCT Pub. Date: Nov. 3, 2022

(65) Prior Publication Data

US 2024/0044102 A1 Feb. 8, 2024

(30) Foreign Application Priority Data

Apr. 26, 2021 (JP) ..... 2021-074398

(51) Int. Cl.
*E02F 3/43* (2006.01)
*E02F 9/26* (2006.01)
*E02F 3/32* (2006.01)

(52) U.S. Cl.
CPC ..... *E02F 3/439* (2013.01); *E02F 9/262* (2013.01); *E02F 3/32* (2013.01)

(58) Field of Classification Search
CPC ..... E02F 3/32; E02F 3/349; E02F 9/262
See application file for complete search history.

(56) References Cited

U.S. PATENT DOCUMENTS 9,856,628 B2 * 1/2018 Kitajima ..... E02F 3/435
11,718,973 B2 * 8/2023 Sasaki ..... E02F 3/435 701/50

(Continued)

FOREIGN PATENT DOCUMENTS

JP 2018-150771 A 9/2018
JP 2020-153731 A 9/2020

(Continued)

OTHER PUBLICATIONS

International Search Repot issued Apr. 19, 2022 in PCT/JP2022/009859 filed on Mar. 8, 2022, 2 pages.

*Primary Examiner* — Andrew Joseph Rudy
(74) *Attorney, Agent, or Firm* — Oblon, McClelland, Maier &Neustadt, L.L.P.

(57) ABSTRACT

A target locus of an attachment is determined while a calculation load for generating the target locus of the attachment is suppressed. A controller is configured to set a position of an arm distal end at a time when a contact detector detects contact of a bucket distal end with an excavation object at a start point of an arm distal end target locus. The controller is configured to receive information about a form of the arm distal end target locus in advance. The controller is configured to set a position for a finish point on the basis of an angle of a surface of the excavation object, an intersection angle between the arm distal end target locus and the surface of the excavation object, information about the form of the arm distal end target locus, and an offset amount about the finish point of the arm distal end target locus.

6 Claims, 8 Drawing Sheets

(56) References Cited

U.S. PATENT DOCUMENTS

| | | | | |
|---|---|---|---|---|
| 12,146,293 | B2 * | 11/2024 | Izumi | E02F 3/43 |
| 2018/0313062 | A1 | 11/2018 | Tsukamoto | |
| 2020/0048861 | A1 | 2/2020 | Narikawa et al. | |
| 2020/0217050 | A1 | 7/2020 | Chiba et al. | |
| 2021/0332561 | A1 | 10/2021 | Kozui et al. | |
| 2022/0120058 | A1 | 4/2022 | Tsukamoto | |
| 2022/0145580 | A1 | 5/2022 | Igarashi et al. | |
| 2022/0170234 | A1 | 6/2022 | Nakano et al. | |
| 2022/0259834 | A1 | 8/2022 | Chiba et al. | |
| 2023/0041186 | A1 * | 2/2023 | Hoso | E02F 3/435 |
| 2024/0159023 | A1 * | 5/2024 | Kamado | G01C 21/16 |

FOREIGN PATENT DOCUMENTS

| | | | |
|---|---|---|---|
| JP | 2021-50494 | A | 4/2021 |
| WO | WO 2017/115810 | A1 | 7/2017 |
| WO | WO 2019/049248 | A1 | 3/2019 |
| WO | WO 2020/045579 | A1 | 3/2020 |
| WO | WO 2021/065384 | A1 | 4/2021 |

* cited by examiner

TARGET PATH GENERATION SYSTEM

TECHNICAL FIELD

The present invention relates to a target locus generation system that generates a target locus of an attachment included in a working machine.

BACKGROUND ART

For instance, Patent Literature 1 describes an invention for generating a target locus (a recommended line for a bucket tip in Patent Literature 1) of an attachment.

CITATION LIST

Patent Literature

Patent Literature 1: International Unexamined Patent Publication No. 2017/115810

The technology described in Patent Literature 1 fails to show how to generate the target locus of the attachment in detail. Further, suppression of a calculation load is demanded in generating the target locus of the attachment.

SUMMARY OF INVENTION

An object of the present invention is to provide a target locus generation system that enables determination of a target locus of an attachment while suppressing a calculation load for generating the target locus.

A target locus generation system is adoptable for a working machine that has a machine main body and an attachment. The attachment includes a boom tiltably attached to the machine main body, an arm rotatably attached to the boom, and a bucket rotatably attached to the arm for excavating an excavation object. The target locus generation system includes: a posture detector that detects a posture of the attachment; a contour detector that detects information about a contour of the excavation object; a contact detector that detects contact of a distal end of the bucket with the excavation object; and a controller. The controller is configured to receive information about a form of an arm distal end target locus being a target locus of a distal end of the arm, information about an intersection angle being an angle between a surface of the excavation object and the arm distal end target locus, and information about an offset amount being a distance between a finish point of the arm distal end target locus and the surface of the excavation object. The controller is configured to set a position of the distal end of the arm at a time when the contact detector detects a change to a state of the contact of the distal end of the bucket with the excavation object from a state of no contact with the excavation object at a start point of the arm distal end target locus. The controller is configured to set a position for the finish point of the arm distal end target locus on the basis of the contour of the excavation object detected by the contour detector, the intersection angle, the information about the form of the arm distal end target locus, and the offset amount.

DESCRIPTION OF EMBODIMENTS

Figure 1:
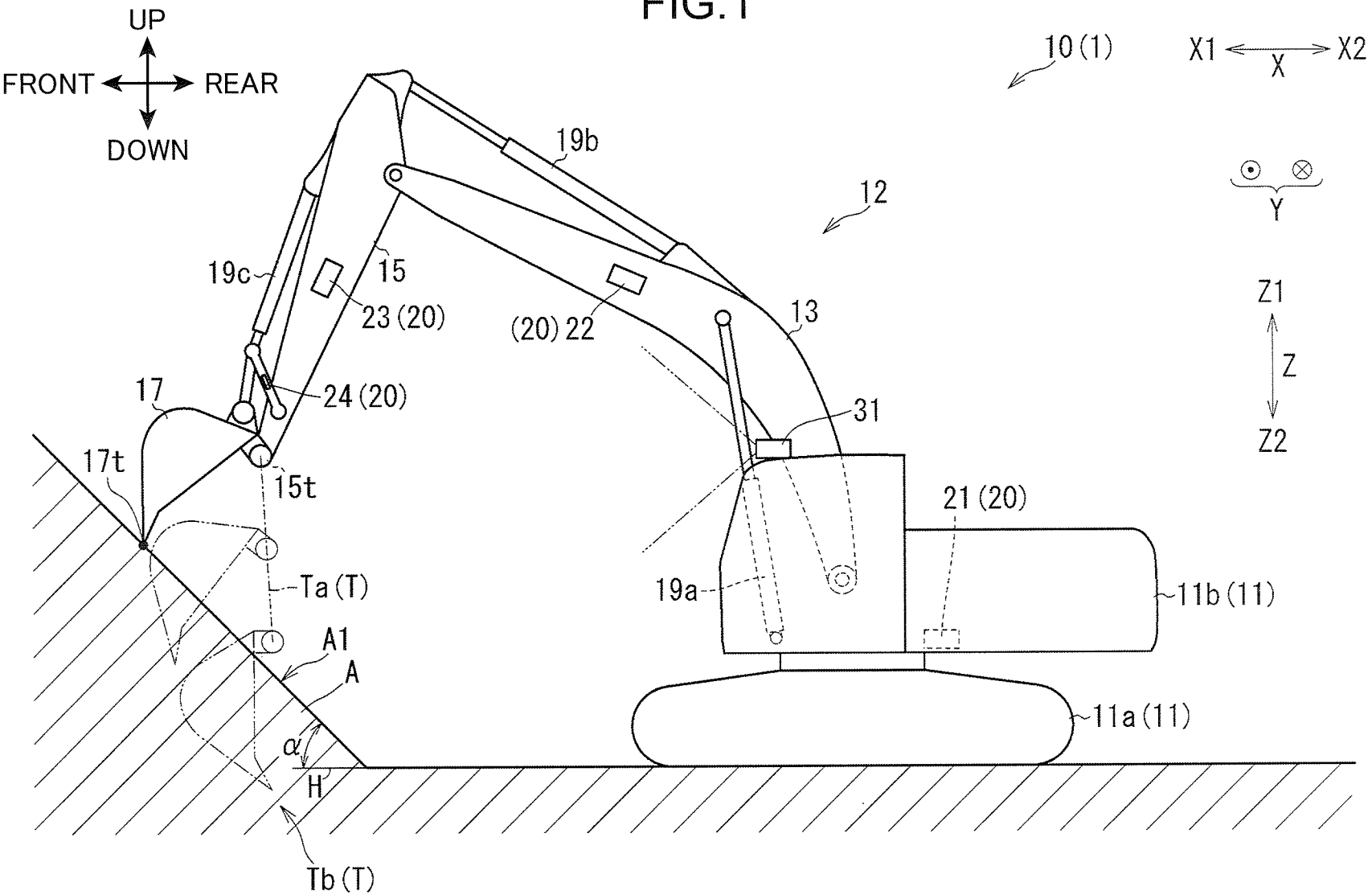
FIG. 1 is a side view of a working machine that adopts a target locus generation system according to an embodiment of the present invention.
Figure 2:
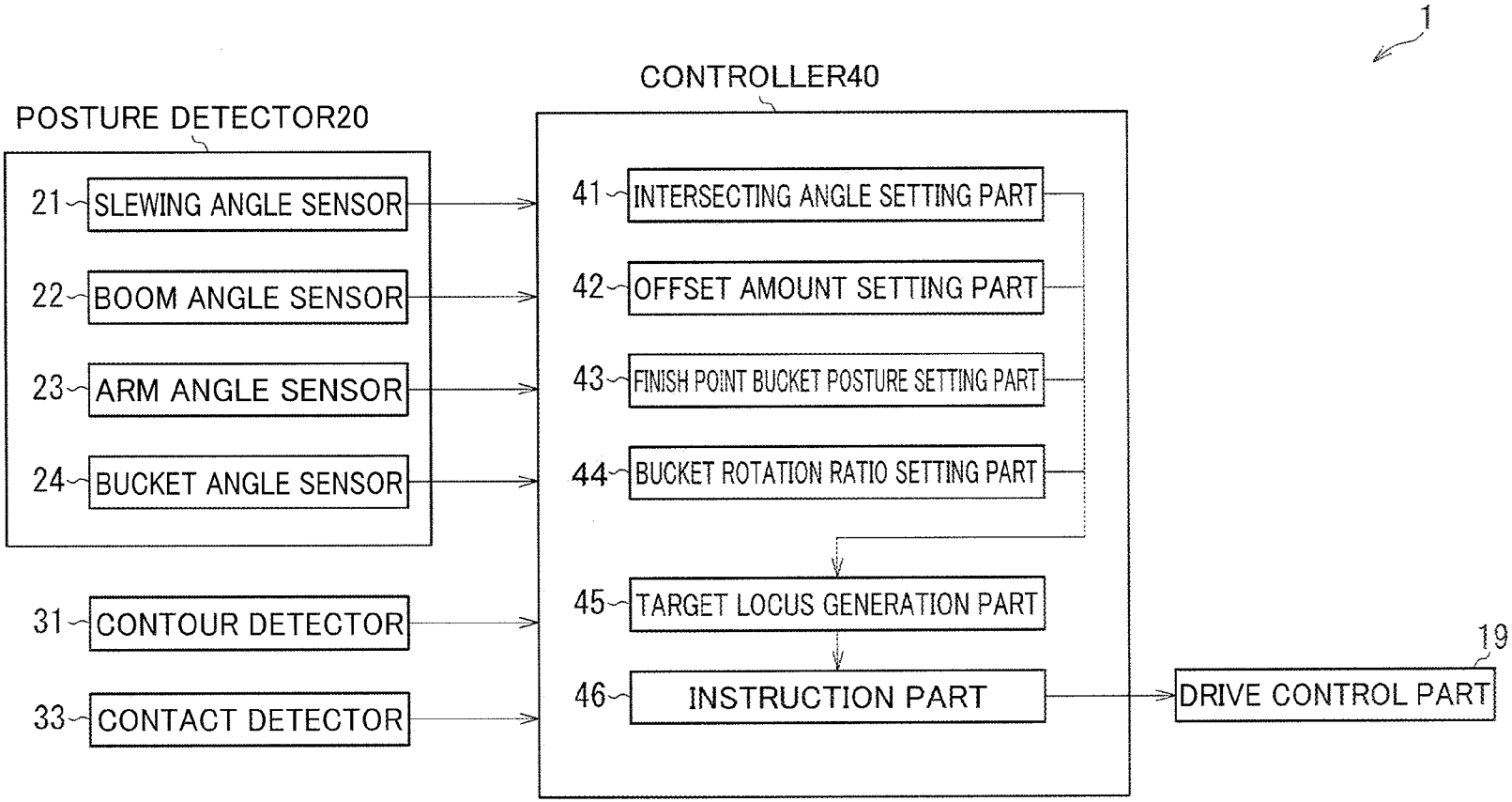
FIG. 2 is a block diagram of the target locus generation system shown in FIG. 1.
Figure 3:
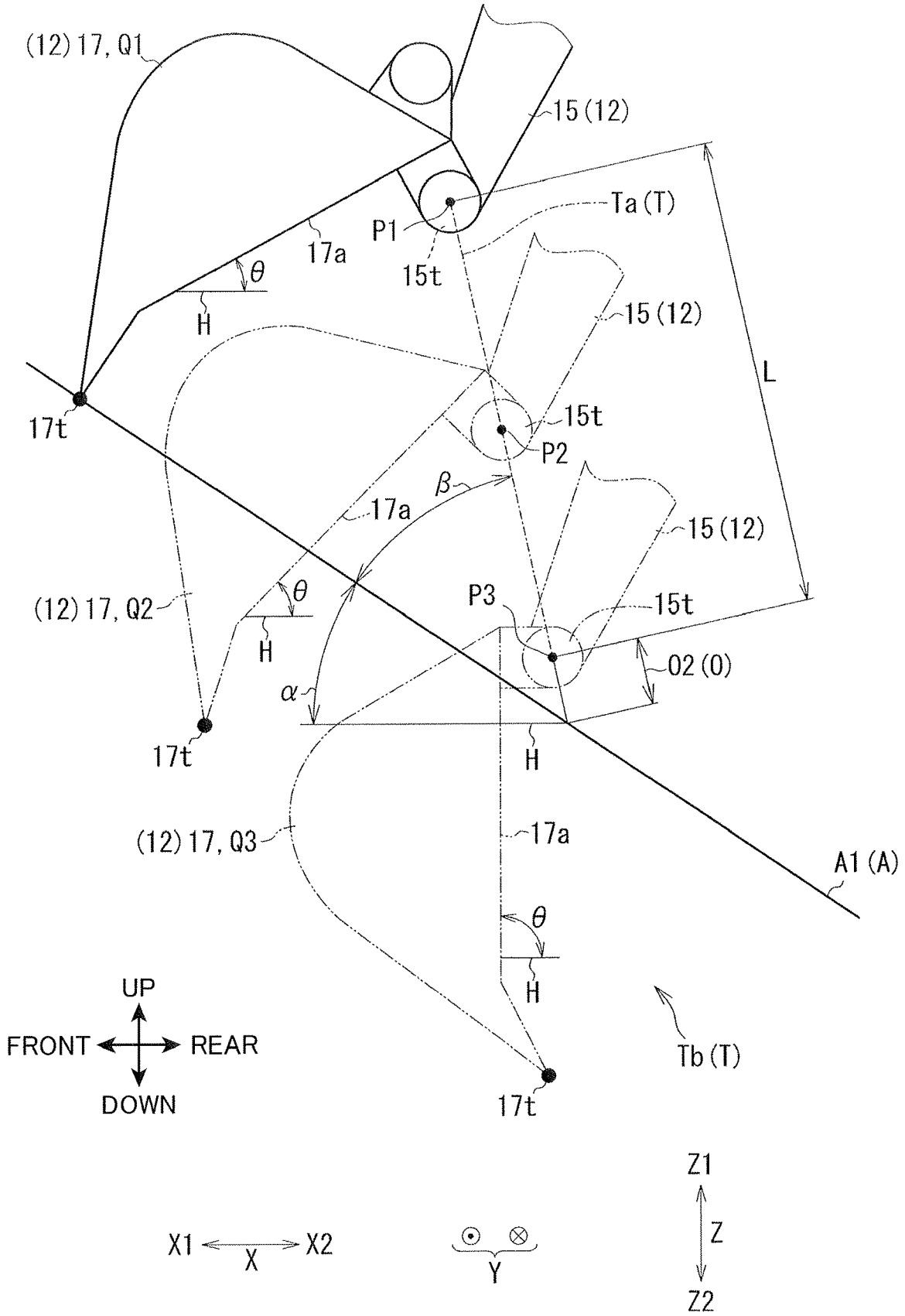
FIG. 3 is a side view of a target locus T of each of a bucket and an arm distal end illustrated in FIG. 1.

A target locus generation system 1 will be described with reference to FIG. 1 to FIG. 8. FIG. 1 is a side view of a working machine 10 that adopts a target locus generation system 1. FIG. 2 is a block diagram of the target locus generation system 1 shown in FIG. 1. FIG. 3 is a side view of a target locus T of each of a bucket 17 and an arm distal end 15*t* illustrated in FIG. 1.

The target locus generation system 1 generates a target locus T of an attachment 12 as shown in FIG. 3. The target locus generation system 1 is adopted for the working machine 10 illustrated in FIG. 1, and includes a posture detector 20, a contour detector 31, a contact detector 33, and a controller 40 each shown in FIG. 2. The target locus generation system 1 may include the working machine 10.

The working machine 10 causes the bucket 17 to perform an excavation work, and is in the form of an excavator as illustrated in FIG. 1. For instance, the working machine 10 is a construction machine that performs a construction work. The working machine 10 includes a machine main body 11, the attachment 12, and a drive control part 19 (see FIG. 2).

The machine main body 11 indicates a main body of the working machine 10. The machine main body 11 includes a lower traveling body 11*a* and an upper slewing body 11*b*. The lower traveling body 11*a* causes the working machine 10 to travel. The lower traveling body 11*a* includes, for example, a crawler. The upper slewing body 11*b* is mounted on the lower traveling body 11*a* slewably about a slewing axis extending in upward and downward directions. A boom 13 (to be described later) included in the working machine 10 is attached to the upper slewing body 11*b*.

Directions

Directions in which the slewing axis of the upper slewing body 11*b* with respect to the lower traveling body 11*a* extends are defined as upward and downward directions Z. Of the upward and downward directions Z, a direction or orientation from the lower traveling body 11*a* to the upper slewing body 11*b* is defined as an upward direction Z1 and a direction opposite thereto is defined as a downward direction Z2. A direction in which a rotation axis of the boom 13 (to be described later) in rising or lowering with respect to the upper slewing body 11*b* extends is defined as a lateral direction Y. Directions perpendicularly intersecting each of the upward and downward directions Z and the lateral direction Y are defined as forward and rearward directions X. Of the forward and rearward directions X, a direction in which the attachment 12 protrudes from the upper slewing body 11*b* is defined as a forward direction X1 (farther side or position) and a direction opposite thereto is defined as a rearward direction X2 (closer side or position).

The attachment 12 is included in the working machine 10 to perform an operation, and includes the boom 13, an arm 15, and a bucket 17. The boom 13 is tiltably attached to the upper slewing body 11*b* (rotatably in the upward and downward directions Z). The arm 15 is rotatably attached to the boom 13. The arm 15 has a distal end (that is opposite to an end of the arm attached to the boom 13) defined as an arm distal end 15*t* (arm top).

The bucket 17 excavates an excavation object A. The bucket 17 has such a shape as to scoop the excavation object A. The bucket 17 is provided on a distal end of the attachment 12 (that is opposite to an end of the attachment attached to the upper slewing body 11*a*). The bucket 17 is rotatably attached to the arm 15. Specifically, the bucket 17 is attached to the arm distal end 15*t* via an unillustrated pin (arm top pin). The bucket 17 has a bucket opening plane 17*a* and a bucket distal end 17*t* as illustrated in FIG. 3. The bucket opening plane 17*a* meets an unillustrated opening of the bucket 17 to communicate with an inside of the bucket 17. The bucket distal end 17*t* is a distal end of the bucket 17 (that is opposite to an end of the bucket attached to the arm 15) to serve as an end edge of the bucket 17.

Examples of the excavation object A to be excavated by the bucket 17 may include soil and sand, and another object, e.g., metal, resin, and rubber, other than the soil and sand. The excavation object A has a surface A1 which may be a planar surface (see FIG. 8) horizontally expanding, or a slope slanted to a horizontal plane. The surface A1 may be planar, substantially planar, or curvy.

The drive control part 19 (FIG. 2) actuates the working machine 10 illustrated in FIG. 1 For instance, the drive control part 19 includes a hydraulic actuator that drives the working machine 10, and an unillustrated hydraulic circuit that controls the hydraulic actuator. The hydraulic actuator constituting the drive control part 19 includes: an unillustrated slewing motor to slew the upper slewing body 11*b* with respect to the lower traveling body 11*a*; a boom cylinder 19*a*; an arm cylinder 19*b*; and a bucket cylinder 19*c*. The boom cylinder 19*a* extends and contracts to lower and raise the boom 13 with respect to the upper slewing body 11*b*. The arm cylinder 19*b* extends and contracts to rotate the arm 15 with respect to the boom 13. The bucket cylinder 19*c* extends and contracts to rotate the bucket 17 with respect to the arm 15. The drive control part 19 controls an operation of the attachment 12 by controlling a rotation of the slewing motor and controlling the extension and the contraction of each of the boom cylinder 19*a*, the arm cylinder 19*b*, and the bucket cylinder 19*c*.

The posture detector 20 detects a posture (position, angle) of the attachment 12. The posture detector 20 includes a slewing angle sensor 21, a boom angle sensor 22, an arm angle sensor 23, and a bucket angle sensor 24. The slewing angle sensor 21 detects a slewing angle of the upper slewing body 11*b* to the lower traveling body 11*a*. The boom angle sensor 22 detects a rotation angle or a tilt angle of the boom 13 to the upper slewing body 11*b*. The boom angle sensor 22 may include an angle sensor attached to a rotary shaft of the boom 13 with respect to the upper slewing body 11*b*. Similarly, each of the slewing angle sensor 21, the arm angle sensor 23, and the bucket angle sensor 24 may include an angle sensor. The boom angle sensor 22 may include a tilt sensor that detects a tilt angle of the boom 13 to the horizontal plane. Similarly, each of the arm angle sensor 23 and the bucket angle sensor 24 may include a tilt sensor. The boom angle sensor 22 may include a stroke sensor that detects a stroke of the boom cylinder 19*a*. Similarly, each of the arm angle sensor 23 and the bucket angle sensor 24 may detect a stroke of the corresponding cylinder. The boom angle sensor 22 may detect a posture of the boom 13 on the basis of a two-dimensional image or a distance image. For example, the contour detector 31 may serve as the boom angle sensor as well. Similarly, the contour detector may serve as each of the slewing angle sensor 21, the arm angle sensor 23, and the bucket angle sensor 24. The arm angle sensor 23 detects a rotation angle of the arm 15 to the boom 13. The bucket angle sensor 24 detects a rotation angle of the bucket 17 to the arm 15. The bucket angle sensor 24 may detect a rotation angle of the bucket 17 to the arm 15 by detecting a posture (e.g., a tilt angle) of a link member connected to the bucket 17 and the arm 15.

The posture detector 20 may detect a position of the working machine 10 on a worksite by using a positioning system (e.g., satellite positioning system). For instance, the posture detector 20 may detect the posture of the attachment 12 on the worksite by detecting a position and an orientation of the upper slewing body 11*b* on the worksite by using the positioning system. The positioning system may be a satellite positioning system, e.g., GNSS (global navigation satellite system). The positioning system may adopt a total station. When the posture detector 20 includes the satellite positioning system, the posture detector 20 may have an antenna to receive a signal for the satellite positioning.

The contour detector 31 detects or acquires information (e.g., a surface angle $\alpha$ to be described later) about a contour of the excavation object A. For instance, the contour detector 31 detects three-dimensional information about a position and a contour of the excavation object A. As an example, the contour detector 31 serves as a photographing device that acquires an image or a distance image having information about a distance (information on a farther position). The contour detector 31 may detect three-dimensional information about the excavation object A on the basis of the distance image and a two-dimensional image. A contour acquisition part that acquires information about the contour of the excavation object A from a storage part may be provided in place of the contour detector 31.

The contour detector 31 may be solely provided as described above, or a plurality of contour detectors 31 may be provided. The contour detector 31 may be mounted to the working machine 10, or arranged on an outside (e.g., the worksite) of the working machine 10. Each of the posture detector 20, the contact detector 33, and the controller 40 shown in FIG. 2 may be arranged in the same manner. The arrangement of the contour detector 31 shown in FIG. 1 on the outside of the working machine 10 may enable detection of a portion (e.g., a shade portion of the attachment 12) which is not detectable in the arrangement of the contour detector 31 in the working machine 10. Further, the arrangement of the contour detector 31 on the outside of the working machine 10 makes the target locus generation system 1 according to the embodiment applicable to a working machine 10 that does not include such a contour detector 31.

The contour detector 31 may include a device that detects three-dimensional information by using a laser beam, for example, may include a LiDAR (Light Detection and Ranging, or a Laser Imaging detection and Ranging), or may include a TOF (Time of Flight sensor). The contour detector 31 may include a device (e.g., a millimeter-wave radar) that detects three-dimensional information by using radio waves. The contour detector 31 may include a stereo camera. The contour detector 31 may include a camera that can detect a two-dimensional image in a case where the contour detector 31 detects a three-dimensional position and a three-dimensional contour of the excavation object A on the basis of three-dimensional information and two-dimensional information.

The contact detector 33 (see FIG. 2) detects contact of the bucket distal end 17*t* with the excavation object A. For instance, the contact detector 33 may detect the contact of the bucket distal end 17*t* with the excavation object A by detecting a pressure acting on the hydraulic cylinder (e.g., the bucket cylinder 19*c*) to actuate the attachment 12. The contact detector 33 may detect the contact of the bucket distal end 17*t* with the excavation object A on the basis of a two-dimensional image or a distance image showing the bucket 17 and the excavation object A. In this case, the two-dimensional image or distance image may be detected as a result from the contour detector 31.

The controller 40 executes input and output of a signal, calculation or computation (processing), and storing of information, as shown in FIG. 2. For instance, the controller 40 acquires information about a posture of the attachment 12 (see FIG. 1) detected by the posture detector 20. For example, the controller 40 stores a result of the calculation. The controller 40 serves as an automatic operative controller that controls the working machine 10 (see FIG. 1) to automatically operate. The controller 40 controls the operation of the attachment 12 in such a manner that the attachment 12 shifts along the target locus T illustrated in FIG. 3. The controller 40 includes a CPU (Central Processing Unit), a ROM (Read Only Memory) which stores a control program, and a RAM (Random Access Memory) for use as a work area of the CPU. As shown in FIG. 2, when the CPU executes the control program stored in the ROM, the controller 40 serves to include functional parts of an intersection angle setting part 41 (intersection angle receiving part), an offset amount setting part 42 (offset amount receiving part), a finish point bucket posture setting part 43 (finish point bucket posture receiving part), a bucket rotation ratio setting part 44 (bucket rotation ratio receiving part), a target locus generation part 45, and an instruction part 46. The functional parts have no entities, and respectively correspond to units of functions to be executed by the control program. That is to say, the controller 40 can practically and comprehensively execute the control to be executed by the functional parts. The functional parts may be respectively allotted to a plurality of controllers. In this case, the controllers constitute the controller of the present invention.

The intersection angle setting part 41 sets an intersection angle β (see FIG. 3) to be described later, in other words, receives information about the intersection angle β. The offset amount setting part 42 sets an offset amount O to be described later, in other words, receives information about the offset amount O. The finish point bucket posture setting part 43 sets a finish point bucket posture Q3 (see FIG. 3) to be described later, in other words, receives information about the finish point bucket posture Q3. The bucket rotation ratio setting part 44 sets a bucket rotation ratio p2θ_ratio to be described later, in other words, receives information about the bucket rotation ratio p2θ_ratio.

The target locus generation part 45 generates a target locus T (target path, see FIG. 3) to be described later. The instruction part 46 controls the attachment 12 in such a manner that the attachment 12 shifts along the target locus T illustrated in FIG. 3. The instruction part 46 shown in FIG. 2 inputs an instruction of a target speed of each actuator (e.g., the boom cylinder 19*a*, see FIG. 1) to the drive control part 19 on the basis of a difference between information about the target locus T and information about a current posture of the attachment 12 (see FIG. 1).

Target Locus T

The target locus T illustrated in FIG. 3 is generated by the target locus generation part 45 (see FIG. 2). The target locus T includes an arm distal end target locus Ta and a bucket target locus Tb.

The arm distal end target locus Ta is a target locus T of the arm distal end 15*t*. The target locus generation part 45 sets, acquires, or receives information about a form of the arm distal end target locus Ta in advance (before generation of the target locus T). The term "information about a form of the arm distal end target locus Ta" means information specifying what form the arm distal end target locus Ta has. The form of the arm distal end target locus Ta is variously settable.

Example A1

For instance, the arm distal end target locus Ta is set to be linear. This configuration suppresses a calculation load by the target locus generation part 45 (see FIG. 2) more effectively than a configuration in which the arm distal end target locus Ta is not linear.

Example A2

For instance, the arm distal end target locus Ta may be substantially linear, curvy, polylinear, or linear and curvy in combination. In the case of the "curvy" form, at least a part of the form may be an arc, a circular arc, or a substantially circular arc.

The controller 40 (see FIG. 2) controls the attachment 12 in such a manner that the arm distal end 15*t* shifts along the arm distal end target locus Ta. An actual shifting locus of the arm distal end 15*t* does not need to exactly agree with the arm distal end target locus Ta. For instance, the actual shifting locus of the arm distal end 15*t* may be substantially linear even when the arm distal end target locus Ta is linear.

The arm distal end target locus Ta viewed in the lateral direction Y may tilt with respect to the upward and downward directions Z, may be in the upward and downward directions Z, or may be in the forward and rearward directions X. For example, the arm distal end target locus Ta viewed in the forward and rearward directions X (not shown) may be in or be substantially in the upward and downward directions Z. In this case, the upper slewing body 11*b* illustrated in FIG. 1 does not slew or does not substantially slew with respect to the lower traveling body 11*a* in the shifting of the arm distal end 15*t* along the arm distal end target locus Ta. As illustrated in FIG. 3, the arm distal end target locus Ta bears a start point P1, a finish point P3, and an intermediate point P2.

The start point P1 is a point of the arm distal end target locus Ta at which the arm distal end 15*t* starts to shift. The finish point P3 is a point of the arm distal end target locus Ta at which the shifting of the arm distal end 15*t* finishes. The intermediate point P2 is a specific point between the start point P1 and the finish point P3. For example, the intermediate point P2 may be a middle point between the start point P1 and the finish point P3, or may be a specific point other than the middle point between the start point P1 and the finish point P3. Here, a plurality of intermediate points P2 may be set.

The bucket target locus Tb is a target locus T of the bucket 17. The bucket target locus Tb indicates information about a posture (a position and an angle) of the bucket 17 at a time when the arm distal end 15*t* shifts from the start point P1 to the finish point P3. For instance, the bucket target locus Tb may include information about an angle of the bucket 17 with respect to a reference direction. Besides, for example, the bucket target locus Tb may include information about an angle or a bucket rotation angle θ of the bucket opening plane 17*a* with respect to a horizontal direction H. The bucket target locus Tb may include information on a position of the bucket distal end 17*t*. Hereinafter, the bucket target locus Tb including the information about the bucket rotation angle θ will be mainly described. The posture of the bucket 17 includes a start point bucket posture Q1, a finish point bucket posture Q3, and an intermediate point bucket posture Q2.

The start point bucket posture Q1 is a posture of the bucket 17 at a time when the arm distal end 15*t* is at the start point P1. More specifically, the start point bucket posture Q1 is a posture of the bucket 17 detected by the posture detector 20 when the arm distal end 15*t* is at the start point P1. The finish point bucket posture Q3 is a posture of the bucket 17 at a time when the arm distal end 15*t* is at the finish point P3. The intermediate point bucket posture Q2 is a posture of the bucket 17 at a time when the arm distal end 15*t* is at the intermediate point P2. The target locus generation part 45 (see FIG. 2) sets the bucket target locus Tb in such a manner that the bucket 17 continuously changes from the start point bucket posture Q1 to the finish point bucket posture Q3. A direction in which the bucket 17 rotates in the change of the posture of the bucket 17 from the start point bucket posture Q1 to the finish point bucket posture Q3 agrees with a direction in which the bucket 17 excavates the excavation object A (in which the bucket rotation angle θ increases in the example shown in FIG. 3). A rotation speed of the bucket 17 in the change of the posture of the bucket 17 from the start point bucket posture Q1 to the finish point bucket posture Q3 may be constant or may vary (see the description below about the bucket rotation ratio p2θ_ratio).

Information Set Before Generation of the Target Locus T

As described above, the target locus generation part 45 (see FIG. 2) sets, receives an input of, or acquires information about the form of the arm distal end target locus Ta before the target locus generation part 45 generates the target locus T in advance. Besides, the controller 40 (see FIG. 2) sets, receives an input of, or acquires an intersection angle β, an offset amount O, a finish point bucket posture Q3, and a bucket rotation ratio p2θ_ratio before the target locus generation part 45 generates the target locus T in advance.

The intersection angle β is an angle between the arm distal end target locus Ta and the surface A1 of the excavation object A. In a case where the arm distal end target locus Ta is linear, the intersection angle β indicates, for example, an angle defined by the surface angle α detected by the contour detector 31 (see FIG. 2) and the arm distal end target locus Ta. As shown in FIG. 1, the surface angle α is an angle of the surface A1 of the excavation object A to a horizontal plane (a ground surface, or a predetermined reference plane). In a case where the arm distal end target locus Ta is not linear (e.g., is curvy), the intersection angle β may be an angle between: a straight line passing through the start point P1 and the finish point P3; and the surface A1 of the excavation object A. Further, in the case where the arm distal end target locus Ta is not linear, the intersection angle β may be an angle between a direction (e.g., tangent line) in which the arm distal end target locus Ta extends on the start point P1 and the surface A1 of the excavation object A. The intersection angle β is set by, input to, or acquired by the intersection angle setting part 41 (see FIG. 2). The intersection angle β may be a fixed value, may be a value manually input by an operator, or may be a value automatically calculated by the controller 40 under a specific condition. Similarly, each of the offset amount O, the finish point bucket posture Q3, and the bucket rotation ratio p2θ_ratio may have a value calculated in the same manner.

For instance, as the intersection angle β is larger, the excavation object A is excavated deeper and an excavation quantity of the excavation object A is greater. As the intersection angle β is smaller, the excavation object A is excavated shallower and the excavation quantity of the excavation object A is smaller. For instance, when the excavation quantity of the excavation object A is too excessive, the excavation object A is more likely to spill out of the bucket 17. By contrast, when the excavation quantity of the excavation object A is too small, the work efficiency of excavation is low. Here, an appropriate setting of the intersection angle β allows the excavation quantity of the excavation object A to be appropriate.

For instance, as the intersection angle β is larger, the load applied to the attachment 12 is greater. As the intersection angle β is smaller, the load applied to the attachment 12 is smaller. The appropriate setting of the intersection angle β allows the load applied to the attachment 12 to be appropriate. For instance, as the excavation object A is harder, the load applied to the attachment 12 becomes greater. In a case where the load applied to the attachment 12 is too excessive, a setting of the intersection angle β to a smaller value suppresses the load applied to the attachment 12 (enables release of the load).

Figure 4:
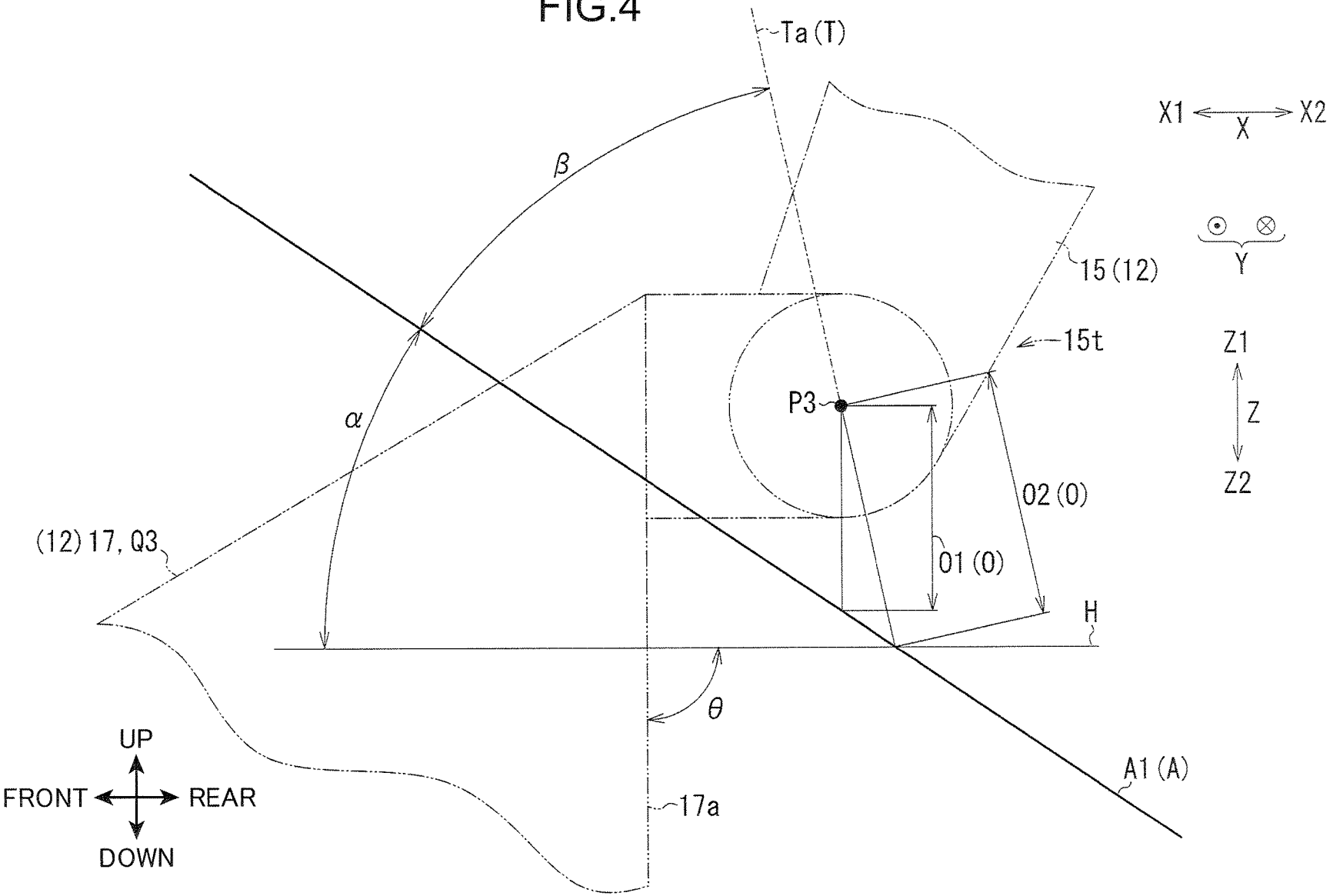
FIG. 4 is an enlarged view of a periphery around a finish point P3 in FIG. 3.

FIG. 4 is an enlarged view of a periphery around the finish point P3 in FIG. 3. As shown in FIG. 4, the offset amount O is a distance between the finish point P3 and the surface A1. The offset amount O may be a vertical directional distance (vertical directional offset amount O1) between the finish point P3 and the surface A1. Also, the offset amount O may be a distance (extension directional offset amount O2) between the finish point P3 and the surface A1 in a direction in which the arm distal end target locus Ta extends. The offset amount O may indicate a distance (now shown) between the finish point P3 and the surface A1 in a direction perpendicularly intersecting the surface A1.

The offset amount O is set by, acquired by, or input to the offset amount setting part 42 (see FIG. 2). The finish point P3 may be on the surface A1. In other words, the offset amount O may be zero. The finish point P3 may be set above the surface A1. The offset amount O in this case is defined as a positive value. The finish point P3 may be set below the surface A1. The offset amount O in this case is defined as a negative value. As the offset amount O is smaller, the excavation object A is excavated deeper. As the offset amount O is greater, the excavation object A is excavated shallower. An appropriate setting of the offset amount O allows the excavation quantity of the excavation object A to be appropriate and allows the load applied to the attachment 12 to be appropriate (in the same manner as the setting of the intersection angle β).

For instance, the offset amount O is set so that a position for the finish point P3 comes near the surface A1. Specifically, in a view in the lateral direction Y as shown in FIG. 3, a direct distance from the rotation center (the start point P1 in FIG. 3) of the bucket 17 to the bucket distal end 17*t* with respect to the arm 15 is defined as a "length of the bucket opening plane 17*a*". When the offset amount O has a positive value, the offset amount O (the vertical directional offset amount O1, see FIG. 4, or the extension directional offset amount O2) may be 50% of the length of the bucket opening plane 17*a* or less, may be 40% thereof or less, may be 30% thereof or less, may be 20% thereof or less, or may be 10% thereof or less. The offset amount O may be 0% of the length of the bucket opening plane 17*a* or more, may be 10% thereof or more, may be 20% thereof or more, may be 30% thereof or more, may be 40% or more, or may be 50% or more. For instance, when the load applied to the attachment 12 is suppressed, the offset amount O may be preferably 30% of the length of the bucket opening plane 17*a* or more, more preferably 40% thereof or more, and still more preferably 50% thereof or more. For instance, in an attempt to ensure a maximal excavation quantity of the excavation object A, the offset amount O may be preferably 20% of the length of the bucket opening plane 17*a* or less, more preferably 10% thereof or less, or still more preferably 0% thereof or less (that is, the finish point P3 is preferably at the same height level as the surface A1 or below the surface A1).

For instance, the offset amount O is set in such a manner that an entirety or substantially entirety of the bucket opening plane 17*a* at a time when the bucket 17 is in the finish point bucket posture Q3 is located in an inner position than the surface A1 (in front of and below the surface A1) before excavation. For instance, a proportion of the bucket opening plane 17*a* (which is a specific example of the "entirety or substantially entirety") in the inner position than the surface A1 before the excavation in the finish point bucket posture Q3 may be 50% or more, may be 60% or more, may be 70% or more, may be 80% or more, may be 90% or more, or may be 100%. The proportion may be 90% or less, may be 80% or less, may be 70% or less, may be 60% or less, or 50% or less. For instance, in an attempt to suppress the load applied to the attachment 12, the proportion is preferably 80% or less, more preferably 70% or less, still more preferably 60% or less, and further more preferably 50% or less. For example, in an attempt to ensure a maximal excavation quantity of the excavation object A, the proportion is preferably 80% or more, more preferably 90% or more, and still more preferably 100%.

The finish point bucket posture Q3 is set by, acquired by, or input to the finish point bucket posture setting part 43 (see FIG. 2). For instance, the finish point bucket posture Q3 is set as a posture (at a bucket rotation angle θ of 90° or substantially 90°) that the bucket opening plane 17*a* extends in a vertical direction or a substantially vertical direction. The bucket rotation angle θ in the finish point bucket posture Q3 may not be 90° or substantially 90°.

The bucket rotation ratio p2θ_ratio is set by, acquired by, or input to the bucket rotation ratio setting part 44 (see FIG. 2). The bucket rotation ratio 2θ_ratio is a ratio of a posture change amount of the bucket 17 from the start point bucket posture Q1 to the intermediate point bucket posture Q2 with respect to a posture change amount of the bucket 17 from the start point bucket posture Q1 to the finish point bucket posture Q3. Specifically, the bucket rotation angle θ changes from 45° at the start point P1 to 90° at the finish point P3, and the bucket rotation angle θ indicates 60° at the intermediate point P2. In this case, a change amount of the bucket rotation angle θ from the start point P1 to the finish point P3 is 45°. The change amount of the bucket rotation angle θ from the start point P1 to the intermediate point P2 is 15°. In this case, the bucket rotation ratio p2θ_ratio is 15/45, that is, about 33%. The numerical value of the bucket rotation angle θ is just an example, and the bucket rotation angle θ from the start point bucket posture Q1 to the finish point bucket posture Q3 may be variously settable.

Generation of the Target Locus T

The target locus T is generated in a manner described below.

Detection of the Contour of the Excavation Object A.

The contour detector 31 shown in FIG. 1 detects information about the contour of the excavation object A. Specifically, the contour detector 31 detects an angle of the surface A1 (surface angle α). For instance, the contour detector 31 detects the surface angle α of the surface A1 at a position where the bucket 17 is about to excavate or therearound. The surface angle α is an angle of the surface A1 with respect to a reference direction (i.e., the horizontal direction H).

Determination of the Start Point P1 and the Start Point Bucket Posture Q1

The position for the start point P1 and the start point bucket posture Q1 illustrated in FIG. 3 are determined in a manner described below. The contact detector 33 (FIG. 2) detects a change to a state of contact of the bucket distal end 17*t* with the excavation object A from a state of no contact with the excavation object. The target locus generation part 45 (FIG. 2) sets a position of the arm distal end 15*t* at this time at the start point P1. The target locus generation part 45 sets a posture of the bucket 17 at this time to the start point bucket posture Q1. For instance, a position for or an x-coordinate of the start point P1 in the forward and rearward directions is defined as "p1x". A position or a z-coordinate of the start point P1 in the upward and downward directions is defined as "p1z". The bucket rotation angle θ in the start point bucket posture Q1 is defined as "p1θ".

Calculation of a Direction and the Finish Point P3 of the Arm Distal End Target Locus Ta The target locus generation part 45 sets, calculates, or generates a position for the finish point P3 on the basis of a surface angle α, an intersection angle β, information about a form of the arm distal end target locus Ta, and an offset amount O.

The target locus generation part 45 sets a direction of the arm distal end target locus Ta on the basis of the surface angle α and the intersection angle β. The "direction of the arm distal end target locus Ta" means a linear shifting direction from the start point P1 to the finish point P3. For instance, the direction of the arm distal end target locus Ta is represented by an angle of the arm distal end target locus Ta with respect to the horizontal direction H. Specifically, the target locus generation part 45 sets, as the direction of the arm distal end target locus Ta, a sum (α+β) of the surface angle α detected by the contour detector 31 (see FIG. 1) and the intersection angle β set by the intersection angle setting part 41 (see FIG. 2). Even in the case where the arm distal end target locus Ta is not linear, the "direction of the arm distal end target locus Ta" may be a linear shifting direction from the start point P1 to the finish point P3. The direction of the arm distal end target locus Ta may be a shifting direction from the start point P1 to the finish point P3 in which the arm distal end target locus Ta extends (e.g., direction in which a tangent line, like a curvy form, of the arm distal end target locus Ta extends) at the start point P1. Hereinafter, the arm distal end target locus Ta being linear will be mainly described.

The target locus generation part 45 calculates a position for the finish point P3, for example, in a manner described below. The target locus generation part 45 calculates the position for the finish point P3 on the basis of a distance, a direct distance, or a shortest distance (length L) from the start point P1 to the finish point P3. For instance, the offset amount O is a distance (extension directional offset amount O2) between the finish point P3 and the surface A1 in the direction in which the arm distal end target locus Ta extends. At this time, the length L has a value obtained by subtracting the offset amount O from the distance from the start point P1 to the surface A1 on a straight line extending in the direction of the arm distal end target locus Ta.

For example, the target locus generation part 45 calculates or sets, on the basis of the direction (at an angle of $\alpha+\beta$) of the arm distal end target locus Ta and the length L, a position coordinate (x-coordinate of p3x, z-coordinate of p3z) of the finish point P3 with, for example, the following equations:

$$p3x=p1x-L\cos(\alpha+\beta);\text{ and}$$

$$p3z=p1z-L\sin(\alpha+\beta).$$

The position for the finish point P3 may be variously calculated. For instance, as shown in FIG. 4, the offset amount O is defined as a vertical directional distance (vertical directional offset amount O1) between the finish point P3 and the surface A1. In this case, the target locus generation part 45 may calculate, as the position for the finish point P3, an intersection between a straight line extending from the start point P1 (see FIG. 3) in the direction of the arm distal end target locus Ta and a plane based on shifting from the surface A1 by the offset amount O in parallel to the vertical direction.

Determination of the Finish Point Bucket Posture Q3

The target locus generation part 45 sets information set by the finish point bucket posture setting part 43 (see FIG. 2) as the finish point bucket posture Q3 illustrated in FIG. 3. Specifically, for instance, the bucket rotation angle θ (defined as "p3θ") in the finish point bucket posture Q3 is 90°.

Calculation of the Intermediate Point P2

The target locus generation part 45 determines a position for the intermediate point P2 on the basis of the position for each of the start point P1 and the finish point P3. For instance, in a case where the position for the intermediate point P2 is a middle point between the start point P1 and the finish point P3, the target locus generation part 45 calculates a position coordinate (x-coordinate of p2x, z-coordinate of p2z) of the intermediate point P2 with the following equations:

$$p2x=(p1x+p3x)/2;\text{ and}$$

$$p2z=(p1z+p3z)/2.$$

Calculation of the Intermediate Point Bucket Posture Q2

The target locus generation part 45 sets a posture between the start point bucket posture Q1 and the finish point bucket posture Q3 as the intermediate point bucket posture Q2. A bucket rotation angle θ (defined as "p2θ") of the intermediate point bucket posture Q2 is an angle between a bucket rotation angle θ (i.e., p1θ) in the start point bucket posture Q1 and a bucket rotation angle θ (i.e., p3θ) in the finish point bucket posture Q3.

The bucket target locus Tb may be set in such a manner that the bucket 17 rotates at a constant rotation speed from the start point bucket posture Q1 to the finish point bucket posture Q3. Specifically, for instance, the target locus generation part 45 may calculate the bucket rotation angle (p2θ) in the intermediate point bucket posture Q2 with the following equation:

$$p2\theta=(p1\theta+p3\theta)/2.$$

The bucket target locus Tb may be set in such a manner that the rotation speed of the bucket 17 changes in accordance with a change in the posture of the bucket 17 from the start point bucket posture Q1 to the finish point bucket posture Q3. For instance, a rotation speed of the bucket 17 in the change from the intermediate point bucket posture Q2 to the finish point bucket posture Q3 may be faster than a rotation speed in the change from the start point bucket posture Q1 to the intermediate point bucket posture Q2. Specifically, the target locus generation part 45 may set the intermediate point bucket posture Q2 on the basis of the bucket rotation ratio p2θ_ratio set by the bucket rotation ratio setting part 44 (see FIG. 2). For instance, the target locus generation part 45 may calculate the bucket rotation angle θ (i.e., p2θ) in the intermediate point bucket posture Q2 with the following equation:

$$p2\theta=p1\theta+(p3\theta-p1\theta)\times p2\theta_\text{ratio}.$$

Here, a plurality of intermediate points P2 may be set. In this case, the bucket rotation ratio p2θ_ratio may be set for each of the intermediate points P2.

After Reaching the Finish Point P3

A target locus of each of the arm distal end 15*t* and the bucket 17 after the arm distal end 15*t* reaches the finish point P3 is variously settable.

Example B1

Figure 5:
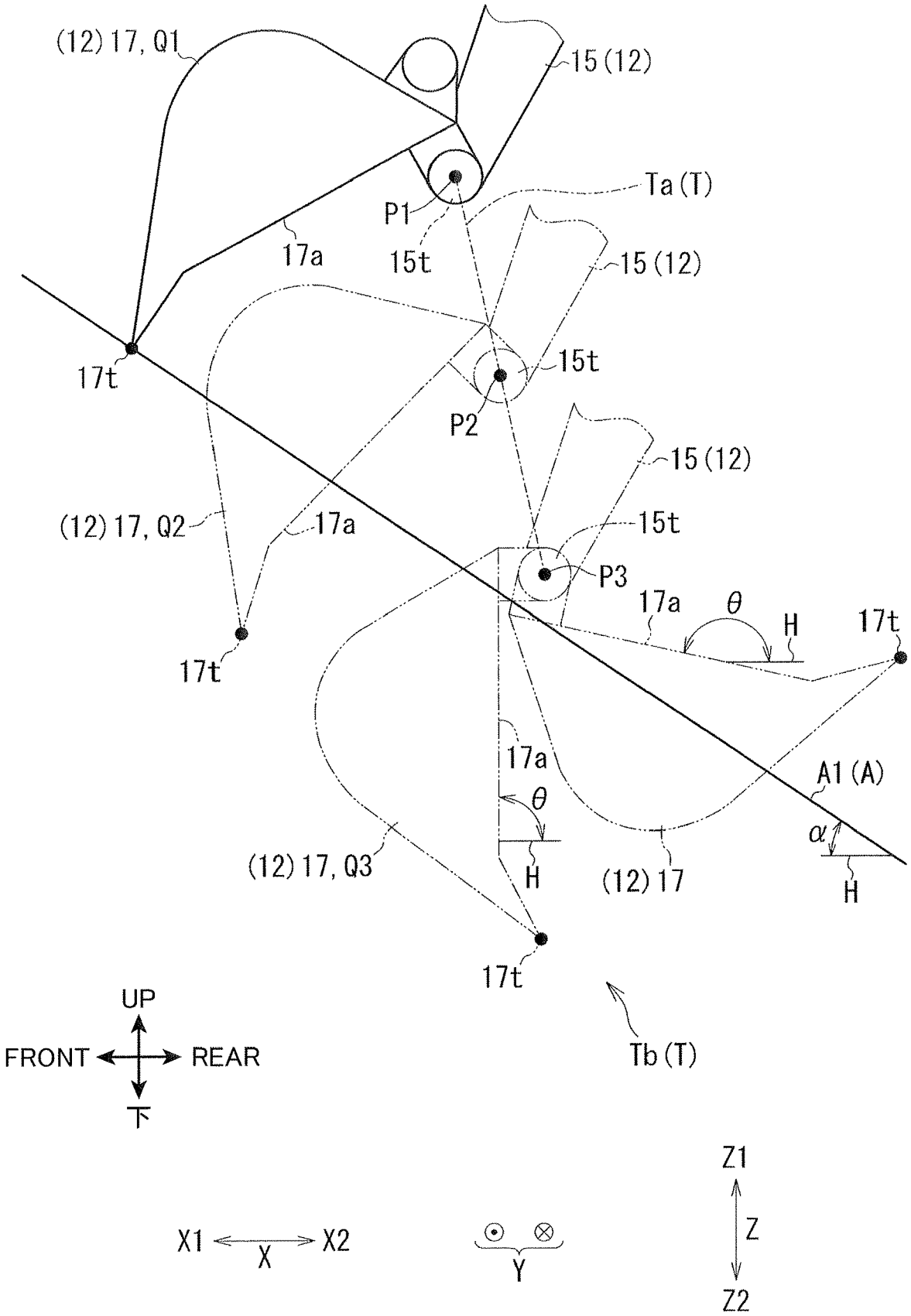
FIG. 5 is an illustration of an example of a rotation of the bucket after the arm distal end illustrated in FIG. 3 reaches the finish point P3.

FIG. 5 is an illustration of an example of a rotation of the bucket 17 after the arm distal end 15*t* illustrated in FIG. 3 reaches the finish point P3. As illustrated in FIG. 5, after the arm distal end 15*t* reaches the finish point P3, the bucket 17 may rotate while the arm distal end 15*t* remains fixed at the position. At this time, the bucket 17 may rotate in a direction in which the bucket rotation angle θ increases (in a direction of scooping the excavation object A). The bucket 17 can scoop the excavation object A in accordance with the rotation of the bucket 17 in this manner. After the bucket 17 rotates to a predetermined angle, the arm distal end 15*t* may shift upward.

Example B2

Figure 6:
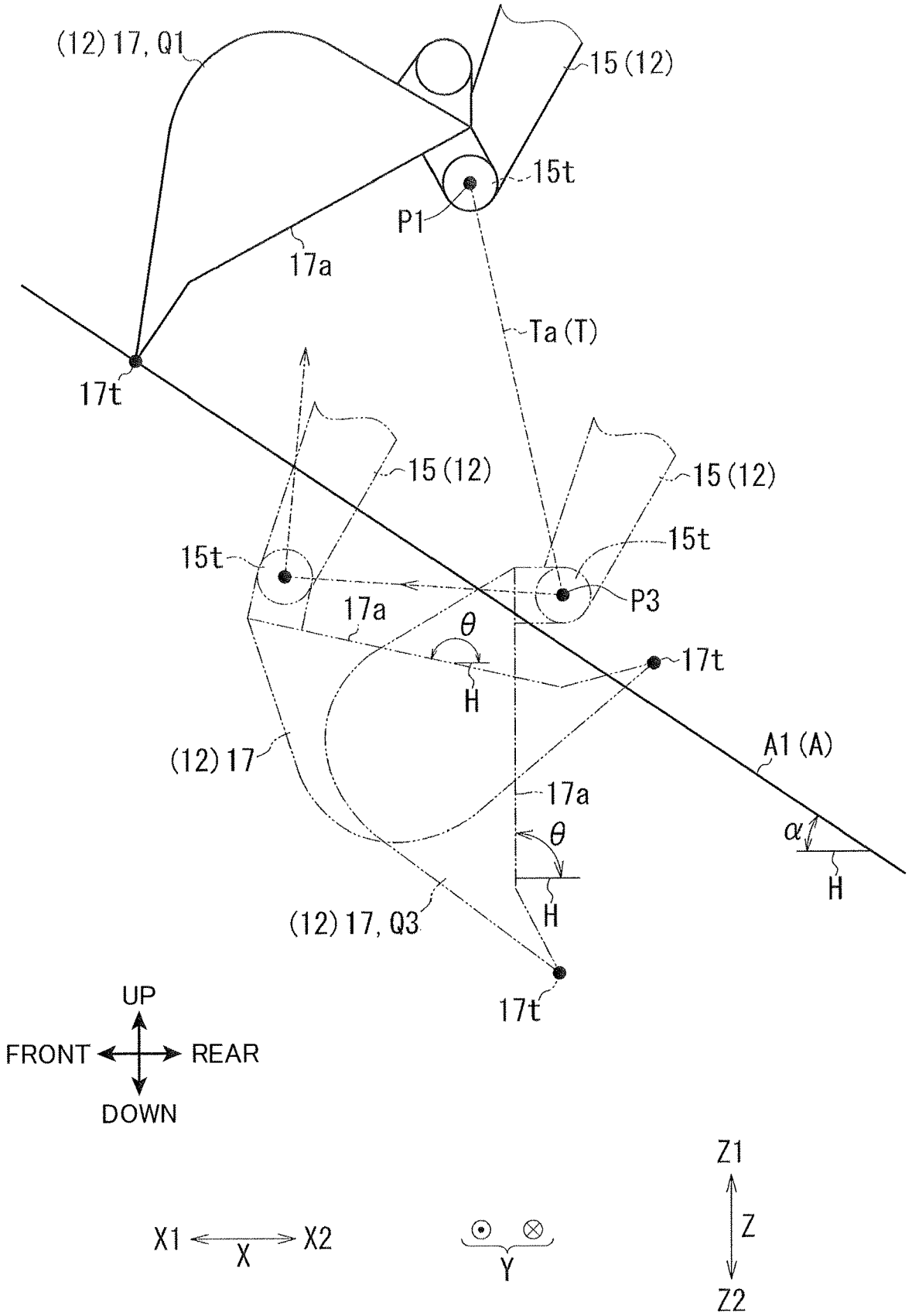
FIG. 6 is an illustration of an example of shifting of the arm distal end and a rotation of the bucket after the arm distal end illustrated in FIG. 3 reaches the finish point P3.

FIG. 6 is an illustration of an example of shifting of the arm distal end 15*t* and a rotation of the bucket 17 after the arm distal end 15*t* illustrated in FIG. 3 reaches the finish point P3. As illustrated in FIG. 6, after the arm distal end 15*t* reaches the finish point P3, the bucket 17 may rotate in the direction in which the bucket rotation angle θ increases while the arm distal end 15*t* shifts forward (in a pushing direction of the arm 15). In this case, the arm distal end 15*t* shifts forward. This keeps the excavation object A located in the rear of the bucket 17 from sliding further rearward. A larger surface angle α is more effective to suppress the rearward sliding of the excavation object A. For example, when the surface A1 is planar (see FIG. 8), the bucket 17 may rotate in a direction in which the bucket rotation angle θ increases in accordance with forward shifting of the arm 15. Further, the rotation of the bucket 17 in the direction in which the bucket rotation angle θ increases in accordance with the forward shifting of the arm 15 prevents the excavation quantity of the excavation object A from being too excessive, and keeps the excavation object A having been excavated from spilling out of the bucket 17. After the arm 15 shifts forward at a predetermined distance and the bucket 17 rotates to a predetermined angle, the arm distal end 15*t* may shift upward.

Various Surface Angles α

Figure 7:
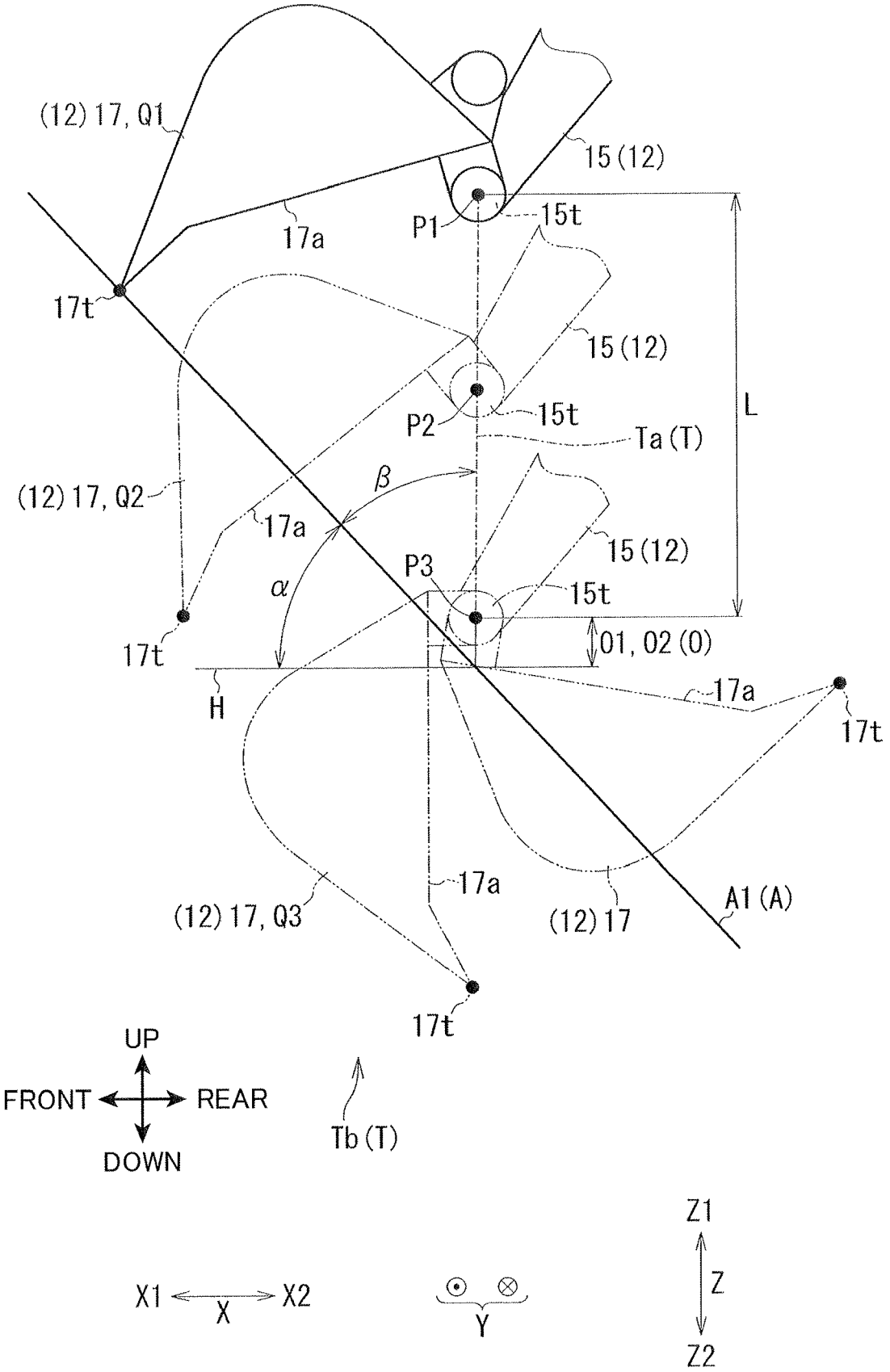
FIG. 7 is an illustration corresponding to FIG. 3 except that a tilt of a surface A1 shown in FIG. 3 is steeper than that of the surface in the example shown in FIG. 3.
Figure 8:
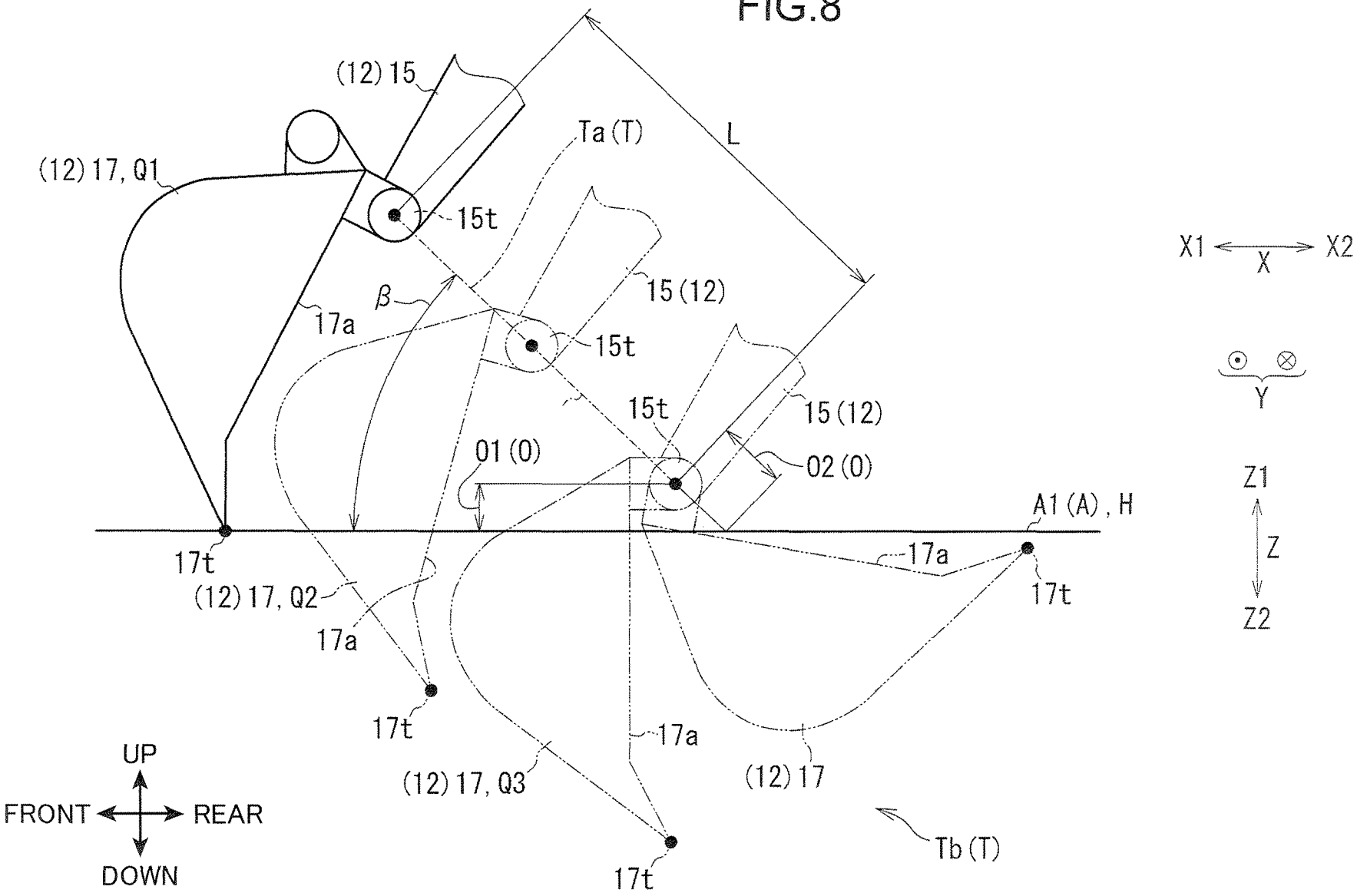
FIG. 8 is an illustration corresponding to FIG. 3 except that a surface A1 is planar unlike the surface in FIG. 3.

As described above, the target locus generation part 45 calculates, as shown in FIG. 3, the position for the finish point P3 on the basis of a detected position for the start point P1 and a detected surface angle α, and on the basis of a form of the arm distal end target locus Ta, an intersection angle β, and an offset amount O, each of the form, intersection angle, and the offset amount being set in advance. The target locus generation part 45 generates the arm distal end target locus Ta on the basis of the start point P1, the finish point P3, and the form of the arm distal end target locus Ta. For instance, in the case where the arm distal end target locus Ta is linear, the target locus generation part 45 defines a straight line connecting the start point P1 and the finish point P3 to each other as the arm distal end target locus Ta. The target locus generation part 45 can calculate the position for the finish point P3 on the basis of the start point P1, the surface angle α, the intersection angle β, the form of the arm distal end target locus Ta, and the offset amount O, regardless of the degree of the surface angle α. The target locus generation part 45 can uniquely determine the arm distal end target locus Ta at various surface angles α. For instance, FIG. 7 is an illustration corresponding to FIG. 3 except that a tilt degree of a surface A1 shown in FIG. 3 is steeper than that of the surface in the example illustrated in FIG. 3. The arm distal end target locus Ta is uniquely determined for each of the surface A1 being a gentle slope (e.g., the surface angle α is larger than about 0° and smaller than 45°) as illustrated in FIG. 3 and the surface A1 being a steeper slope (e.g., the surface angle α is equal to or larger than 45°) as illustrated in FIG. 7. FIG. 8 is an illustration corresponding to FIG. 3 except that a surface A1 is planar unlike the surface in FIG. 3. As illustrated in FIG. 8, the arm distal end target locus Ta is uniquely determined even when the surface A1 is planar (e.g., the surface angle α is about 0°, see FIG. 7). Further, an excavation depth and a load applied to the attachment 12 are changeable owing to the changeable intersection angle β and offset amount O. Even in a change in the surface angle α, an appropriate setting of each of the intersection angle β and the offset amount O achieves suppression of an excessive load applied to the attachment 12 (enables release of the load) while ensuring the excavation quantity of the excavation object A.

The target locus generation part 45 further sets the bucket target locus Tb on the basis of the start point bucket posture Q1 illustrated in FIG. 3, the finish point bucket posture Q3 set by the finish point bucket posture setting part 43 (see FIG. 2), and the uniquely determined arm distal end target locus Ta. The target locus generation part 45 can uniquely determine the bucket target locus Tb at various surface angles α.

The effect by the target locus generation system 1 shown in FIG. 1 will be described below. The target locus generation system 1 includes the attachment 12, the posture detector 20, the contour detector 31, the contact detector 33, and the target locus generation part 45, the intersection angle setting part 41, and the offset amount setting part 42 each shown in FIG. 2. As illustrated in FIG. 1, the attachment 12 includes the boom 13, the arm 15, and the bucket 17. The boom 13 is tiltably attached to the machine main body 11. The arm 15 is rotatably attached to the boom 13. The bucket 17 is rotatably attached to the arm 15 for excavating the excavation object A. The posture detector 20 detects a posture of the attachment 12. The contour detector 31 detects information about a contour of the excavation object A. The contact detector 33 (see FIG. 2) detects contact of the distal end (the bucket distal end 17*t*) of the bucket 17 with the excavation object A. The target locus generation part 45 (see FIG. 2) generates the arm distal end target locus Ta being the target locus T of the distal end (arm distal end target locus 15) of the arm 15 illustrated in FIG. 3. The intersection angle setting part 41 (see FIG. 2) sets the intersection angle β between the surface A1 of the excavation object A and the arm distal end target locus Ta. The offset amount setting part 42 (see FIG. 2) sets the offset amount O being a distance between the finish point P3 of the arm distal end target locus Ta illustrated in FIG. 4 and the surface A1 of the excavation object A.

The target locus generation part 45 (see FIG. 2) sets the position of the arm distal end 15*t* at a time when the contact detector 33 (see FIG. 2) detects a change to a state of contact of the bucket distal end 17*t* illustrated in FIG. 3 with the excavation object A from a state of no contact with the excavation object A at the start point P1 of the arm distal end target locus Ta.

The target locus generation part 45 (see FIG. 2) sets information about a contour of the arm distal end target locus Ta in advance.

The target locus generation part 45 (see FIG. 2) calculates a position for the finish point P3 on the basis of an angle (surface angle α) of the surface A1 of the excavation object A, an intersection angle β set by the intersection angle setting part 41 (see FIG. 2), information about the form of the arm distal end target locus Ta, and an offset amount O set by the offset amount setting part 42 (see FIG. 2).

This configuration determines the position for the start point P1 of the arm distal end target locus Ta, and determines the position for the finish point P3 of the arm distal end target locus Ta. In this configuration, the target locus generation part 45 sets or presets information about the form of the arm distal end target locus Ta. Thus, the target locus generation system 1 can uniquely determine the arm distal end target locus Ta.

In this configuration, the arm distal end target locus Ta is generated on the basis of the surface angle α, the intersection angle β, the form of the arm distal end target locus Ta (information about the form), and the offset amount O. The arm distal end target locus Ta indicates a value set by the target locus generation part 45 (see FIG. 2), the intersection angle β indicates a value set by the intersection angle setting part 41 (see FIG. 2), and the offset amount O indicates a value set by the offset amount setting part 42 (see FIG. 2). Use of the form of the preset arm distal end target locus Ta, intersection angle β, and the offset amount O each being preset leads to facilitated calculation that enables generation of the arm distal end target locus Ta. This achieves suppression of the calculation load by the target locus generation part 45. For instance, this configuration can suppress the calculation load more effectively than a configuration for generating the arm distal end target locus Ta on the basis of a load applied to the attachment 12 and than a configuration for generating the arm distal end target locus Ta on the basis of an amount of work performed by the bucket 17.

This configuration consequently succeeds in uniquely determine the target locus T while suppressing the calculation load for generating the target locus T (specifically, the arm distal end target locus Ta) of the attachment 12.

An appropriate setting of each of the intersection angle β and the offset amount O achieves suppression of the load applied to the attachment 12 while ensuring the excavation quantity of the excavation object A by the bucket 17.

Here, the arm distal end target locus Ta may be linear. The arm distal end target locus Ta viewed in a left-right direction of the upper slewing body 11*b* is linear as illustrated in FIG. 3.

This configuration suppresses a calculation load by the target locus generation part 45 more effectively than a configuration in which the arm distal end target locus Ta is not linear.

As shown in FIG. 2, the target locus generation system 1 includes the finish point bucket posture setting part 43 that sets the finish point bucket posture Q3 illustrated in FIG. 3. The finish point bucket posture Q3 is a posture of the bucket 17 at a time when the arm distal end 15*t* is at the finish point P3 of the arm distal end target locus Ta. The target locus generation part 45 (see FIG. 2) generates the bucket target locus Tb being the target locus T of the bucket 17.

The posture of the bucket 17 detected by the posture detector 20 when the arm distal end 15*t* is at the start point P1 of the arm distal end target locus Ta is defined as the start point bucket posture Q1. The target locus generation part 45 (see FIG. 2) sets the bucket target locus Tb in such a manner that the bucket 17 continuously changes from the start point bucket posture Q1 to the finish point bucket posture Q3 set by the finish point bucket posture setting part 43.

In the configuration, the start point bucket posture Q1 is a posture of the bucket 17 detected by the posture detector 20 when the arm distal end 15*t* is at the start point P1. The finish point bucket posture Q3 is a posture set by the finish point bucket posture setting part 43 (see FIG. 2). Thus, the target locus generation part 45 (see FIG. 2) is not required to generate the start point bucket posture Q1 and the finish point bucket posture Q3. This configuration can suppress the calculation load by the target locus generation part 45 (see FIG. 2) more effectively than a configuration which is required to generate the start point bucket posture Q1 and the finish point bucket posture Q3. This consequently succeeds in uniquely determine the bucket target locus Tb while suppressing the calculation load for generating the target locus (specifically, the bucket target locus Tb) of the attachment 12.

A posture of the bucket 17 at a time when the arm distal end 15*t* is at the intermediate point P2 being a specific point between the start point P1 and the finish point P3 of the arm distal end target locus Ta is defined as the intermediate point bucket posture Q2. As shown in FIG. 2, the target locus generation system 1 includes the bucket rotation ratio setting part 44.

The bucket rotation ratio setting part 44 sets the bucket rotation ratio p2θ_ratio. The bucket rotation ratio 2θ_ratio is a ratio of a posture change amount of the bucket 17 from the start point bucket posture Q1 to the intermediate point bucket posture Q2 with respect to a posture change amount of the bucket 17 from the start point bucket posture Q1 to the finish point bucket posture Q3 as illustrated in FIG. 3. The target locus generation part 45 shown in FIG. 2 sets the intermediate point bucket posture Q2 illustrated in FIG. 3 on the basis of the bucket rotation ratio p2θ_ratio set by the bucket rotation ratio setting part 44.

In this configuration, the intermediate point bucket posture Q2 is determined on the basis of the bucket rotation ratio p2θ_ratio. This configuration enables generation of the bucket target locus Tb in such a manner that the rotation speed of the bucket 17 changes before and after the intermediate point P2 in accordance with the setting of the bucket rotation ratio p2θ_ratio. An appropriate setting of the bucket rotation ratio p2θ_ratio allows the bucket 17 to efficiently excavate the excavation object A.

Modifications

The embodiment described above may be modified in various ways. For instance, the arrangement and the shape of each of the constituent elements in the embodiment may be changed. For instance, the connection between or among the constituent elements shown in FIG. 2 may be changed. For instance, a procedure and each equation of the calculation related to the target locus T illustrated in FIG. 3 may be changed. For instance, the number of constituent elements may be changed, and one or more of the constituent elements are excludable. For instance, the constituent elements may be fixed to, or connected to or with each other in a direct way or an indirect way. For instance, the constituent elements are described as members different from one another or a part of the structure, but may cover a single member or a part of a specific member. For example, the constituent element described as a single member or a part of a specific member may cover a plurality of members or parts different from one another. Specifically, for example, each of the posture detector 20, the contour detector 31, and the contact detector 33 shown in FIG. 2 may serve as the other two elements. The constituent elements (including the intersection angle setting part 41 and the offset amount setting part 42) of the controller 40 may be collectively provided in the single controller 40, or may be separated into groups.

The present invention provides a target locus generation system for a working machine that has: a machine main body; and an attachment including a boom tiltably attached to the machine main body, an arm rotatably attached to the boom, and a bucket rotatably attached to the arm for excavating an excavation object. The target locus generation system includes: a posture detector that detects a posture of the attachment; a contour detector that detects information about a contour of the excavation object; a contact detector that detects contact of a distal end of the bucket with the excavation object; and a controller. The controller is configured to receive information about a form of an arm distal end target locus being a target locus of a distal end of the arm, information about an intersection angle being an angle between a surface of the excavation object and the arm distal end target locus, and information about an offset amount being a distance between a finish point of the arm distal end target locus and the surface of the excavation object. The controller is configured to set a position of the distal end of the arm at a time when the contact detector detects a change to a state of the contact of the distal end of the bucket with the excavation object from a state of no contact with the excavation object at a start point of the arm distal end target locus. The controller is configured to set a position for the finish point of the arm distal end target locus on the basis of the contour of the excavation object detected by the contour detector, the intersection angle, the information about the form of the arm distal end target locus, and the offset amount. In this configuration, the arm distal end target locus may be linear.

In the configuration, the controller is further configured to generate a bucket target locus being a target locus of the bucket. The controller may be configured to: further receive information about a finish point bucket posture being a posture of the bucket at a time when the distal end of the arm is at the finish point of the arm distal end target locus; and set the bucket target locus in such a manner that the posture of the bucket continuously changes to the received finish point bucket posture from a start point bucket posture being a posture of the bucket detected by the posture detector when the distal end of the arm is at the start point of the arm distal end target locus.

In the configuration, the controller may be configured to: further receive information about a bucket rotation ratio being a ratio of a posture change amount of the bucket from the start point bucket posture to an intermediate point bucket posture with respect to a posture change amount of the bucket from the start point bucket posture to the finish point bucket posture, the intermediate point bucket posture being a posture of the bucket at a time when the distal end of the arm is at an intermediate point being a specific point between the start point and the finish point of the arm distal end target locus; and set the intermediate point bucket posture on the basis of the received bucket rotation ratio.

In the configuration, the controller may be configured to receive, as the contour of the excavation object, an angle of the surface of the excavation object to a predetermined reference plane; and set the position for the finish point of the arm distal end target locus on the basis of the angle of the surface, the intersection angle, the information about the form of the arm distal end target locus, and the offset amount.

The configuration may further include a working machine that has: a machine main body; and an attachment including a boom tiltably attached to the machine main body, an arm rotatably attached to the boom, and a bucket rotatably attached to the arm for excavating an excavation object.

The invention claimed is:

1. A target locus generation system for a working machine that has: a machine main body; and an attachment including a boom tiltably attached to the machine main body, an arm rotatably attached to the boom, and a bucket rotatably attached to the arm for excavating an excavation object, the target locus generation system comprising:

a posture detector that detects a posture of the attachment;

a contour detector that detects information about a contour of the excavation object;

a contact detector that detects contact of a distal end of the bucket with the excavation object; and a controller, wherein the controller is configured to:

receive information about a form of an arm distal end target locus being a target locus of a distal end of the arm, information about an intersection angle being an angle between a surface of the excavation object and the arm distal end target locus, and information about an offset amount being a distance between a finish point of the arm distal end target locus and the surface of the excavation object;

set a position of the distal end of the arm at a time when the contact detector detects a change to a state of the contact of the distal end of the bucket with the excavation object from a state of no contact with the excavation object at a start point of the arm distal end target locus; and set a position for the finish point of the arm distal end target locus on the basis of the contour of the excavation object detected by the contour detector, the intersection angle, the information about the form of the arm distal end target locus, and the offset amount.

2. The target locus generation system according to claim 1, wherein the arm distal end target locus is linear.

3. The target locus generation system according to claim 1, wherein the controller is further configured to generate a bucket target locus being a target locus of the bucket, and the controller is configured to:

further receive information about a finish point bucket posture being a posture of the bucket at a time when the distal end of the arm is at the finish point of the arm distal end target locus; and set the bucket target locus in such a manner that the posture of the bucket continuously changes to the received finish point bucket posture from a start point bucket posture being a posture of the bucket detected by the posture detector when the distal end of the arm is at the start point of the arm distal end target locus.

4. The target locus generation system according to claim 3, wherein the controller is configured to:

further receive information about a bucket rotation ratio being a ratio of a posture change amount of the bucket from the start point bucket posture to an intermediate point bucket posture with respect to a posture change amount of the bucket from the start point bucket posture to the finish point bucket posture, the intermediate point bucket posture being a posture of the bucket at a time when the distal end of the arm is at an intermediate point being a specific point between the start point and the finish point of the arm distal end target locus; and set the intermediate point bucket posture on the basis of the received bucket rotation ratio.

5. The target locus generation system according to claim 1, wherein the controller is configured to:

receive, as the contour of the excavation object, an angle of the surface of the excavation object to a predetermined reference plane; and set the position for the finish point of the arm distal end target locus on the basis of the angle of the surface, the intersection angle, the information about the form of the arm distal end target locus, and the offset amount.

6. The target locus generation system according to claim 1, further comprising a working machine that has:

a machine main body; and an attachment including a boom tiltably attached to the machine main body, an arm rotatably attached to the boom, and a bucket rotatably attached to the arm for excavating an excavation object.

* * * * *